United States Patent [19]

Emerson

[11] 4,040,899

[45] Aug. 9, 1977

[54] PRODUCTION OF HIGH STRENGTH PACKAGING PAPERS FROM STRAW

[75] Inventor: James Wade Emerson, Hazlet, N.J.

[73] Assignee: Clupak, Inc., New York, N.Y.

[21] Appl. No.: 528,584

[22] Filed: Nov. 29, 1974

Related U.S. Application Data

[63] Continuation of Ser. No. 268,508, July 3, 1972, abandoned.

[51] Int. Cl.[2] ..... D21C 3/00

[52] U.S. Cl. ..... 162/13; 162/97; 162/148; 162/205; 162/206

[58] Field of Search ..... 162/148, 205, 206, 97, 162/21, 13

[56] References Cited

U.S. PATENT DOCUMENTS

| | | | |
|---|---|---|---|
| 3,454,463 | 7/1969 | Welsh | 162/206 |

FOREIGN PATENT DOCUMENTS

| | | | |
|---|---|---|---|
| 611,916 | 1/1961 | Canada | 162/148 |
| 846,232 | 8/1960 | United Kingdom | 162/148 |

OTHER PUBLICATIONS

Clark et al., "Continuous Pulping of Wheat Straw for Corrugating Media," TAPPI, vol. 43, No. 11, Nov. 1960.

Ernst et al., "Rice Straw for Bleached Papers", TAPPI, vol. 43, No. 1 (Jan. 1960), pp. 49–53.

Casey, "Pulp & Paper", vol. I, (1960), p. 412.

*Primary Examiner*—S. Leon Bashore

*Assistant Examiner*—Peter Chin

[57] ABSTRACT

Modified paper which exhibits high tear resistance and toughness and which contains a high percentage of straw fibers and which has fibers consolidated in a three step process including drawing water off by vacuum, press drying and fiber upsetting.

7 Claims, 1 Drawing Figure

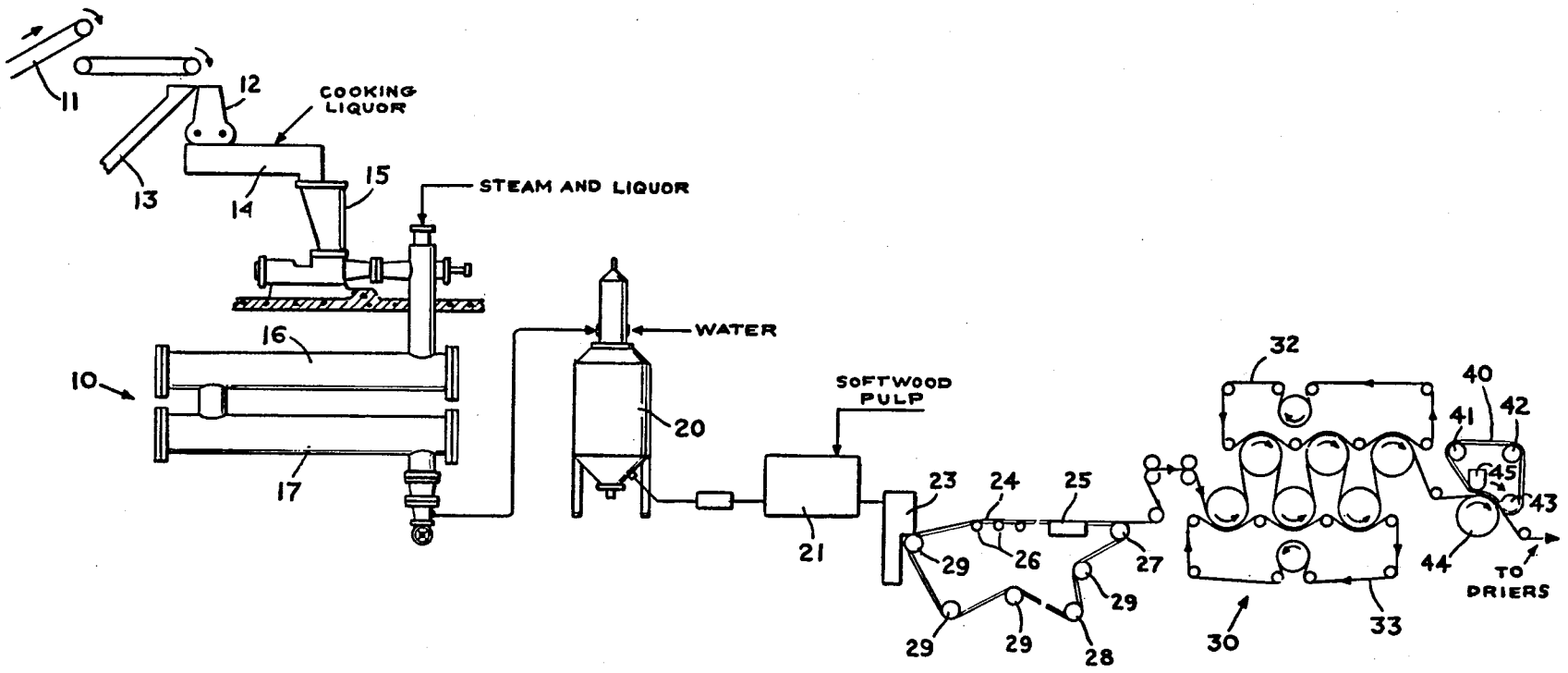
COOKING LIQUOR
STEAM AND LIQUOR
WATER
SOFTWOOD PULP
TO DRIERS
10
11
12
13
14
15
16
17
20
21
23
24
25
26
27
28
29
30
32
33
40
41
42
43
44
45

PRODUCTION OF HIGH STRENGTH PACKAGING PAPERS FROM STRAW

This application is a continuation of Ser. No. 268,508 filed July 3, 1972 now abandoned.

BACKGROUND OF THE INVENTION

The field of the present invention is papermaking and more particularly the making of straw paper having high energy absorbing qualities and high resistance to tear.

Straw paper has been known for centuries and has been used in a wide variety of commercial applications. Straw paper is ordinarily grouped into two major categories. One category is paper made with grass straws. The other is paper made with cereal straws such as wheat, rice and rye. In this test the discussion will be confined to cereal straws although many of the methods described may be applicable to other types of straw utilized in paper making.

Papers made from cereal straw such as wheat and rice are employed in making corrugated medium, egg case stock, decorative wrappings and, when bleached, are used for high grade white papers such as bond, ledger paper and printing papers. However, paper made from straw is not considered to be suitable for sack or bag paper as straw fiber papers are unsuitable for applications where a high tear resistance is a requirement. Therefore, although some low strength decorative wrapping paper is made from straw fibers, high grade packaging and sack papers having a substantial constituent of straw fibers has not heretofore been made. It is well appreciated that a straw fiber paper which exhibits toughness and tear resistance is a desirable product. The instant invention describes such a product and discloses the method used to make it.

In addition, the instant invention allows for making a high basis weight straw paper whereas heretofore due to the slow draining characteristics of straw fiber it has been difficult to produce heavy weight straw paper.

SUMMARY OF THE INVENTION

The instant invention provides for the production of a new straw fiber paper with high tear resistance and high energy absorbing capabilities. Thus this new paper is particularly well suited to commercial applications where heretofore straw paper could not be used. The paper of the instant invention may be utilized in packaging or wrapping especially where tear resistance and toughness are requirements.

The new product is made in a process which includes digesting the straw fibers, washing the cooked straw, adding a proportion of other pulp such as softwood pulp in a thoroughly mixed furnish having at least 40 percent straw fibers, mixing in a rosin sizing where desired, passing the furnish to the forming wire in a specified consistency, consolidating the web on the wire with the aid of suction, further consolidating and partially drying the web and then, while the web is at a specified moisture content, upsetting the fibers of the web all generally in the plane of the web to still further consolidate the web by causing the fibers to crowd together and the straw fibers and the other fibers to intertwine, and then continuing the drying of the web.

In the instant invention the upsetting of the web fibers may be carried out in one direction only or alternatively may be carried out simultaneously or sequentially under the influence of forces acting in mutually crossing directions.

The product of the instant invention is recognized empirically by the particular intertwining of the fibers, by the presence of straw fibers in constituent amount in excess of about 40 percent of the total product weight, by the other fibers such as softwood fibers present and, under test conditions, by its tear strength and energy absorbing characteristics which are better than those of a typical straw paper of similar make-up but not produced according to the teachings of the instant invention.

The upsetting step of the method described herein may be carried out in a variety of ways, nevertheless as will be described later in more detail, the upsetting is preferably carried out in a pressure nip to which the web is fed in a tight draw and while the web is less thar about 50 percent wet. it is an aim of the instant invention to provide an improved straw paper A further object is to provide a method for making straw paper which is suitable for wrapping and packaging applications.

Another object is to provide a heavy basis weight straw paper.

Another object is to provide a method for making high basis weight straw papers.

A further object is to provide a high basis weight straw paper which exhibits high tear resistance and toughness.

To accomplish these and other objects of the present invention, the invention comprises the features hereinafter described and particularly set out in the claims, the description setting forth in detail certain illustrative embodiments of the invention. These embodiments are set out to show some of the ways in which the principles of the invention may be employed.

For a more complete understanding of the invention, reference should be made to the drawing wherein is shown an apparatus suitable for carrying out the process of the invention and making the product of the invention. The drawing is to be understood to be more or less of a diagrammatic character for purposes of illustration.

DESCRIPTION OF THE INVENTION

The instant invention will be described with respect to particular apparatus which may be used to produce the product of the invention. It will be appreciated that the various principles hereinafter described are applicable to other apparatus configurations.

Where reference is made to treated paper, the reference will indicate paper which has been made according to the process as set out herein.

The following description will be in connection with the drawing which shows the various apparatus elements used to produce the new straw paper. To begin the process, the straw to be used in making the new product must first be cut into the proper lengths. It is desirable that the straw be cut so that the majority of the pieces are in the range of approximately 1 to 3 inches in length. Preferably the pieces should be cut so that their lengths are fairly uniform to facilitate processing.

The cut straw will typically have many small loose fibers and dust particles as well as seeds and dirt. These impurities must be removed. The initial cleaning may be carried out by passing the cut pieces through a cyclone separator which removes the dust and loose fibers. This operation is followed by mechanical rolling or pressing to break the straw and to partially separate the fibers. Rolling and pressing aids in penetration of the cooking liquor in later processing.

Referring to the drawing, the cut and cleaned straw is passed to a digester or "cooker" designated generally as 10 upon a conveyor 11. The straw is metered into the digester through a metering system 12. Excess straw is carried off on a second conveyor 13. The straw delivered to the digester should be approximately 17 percent by weight and be fairly uniformly at this moisture. Wet washing may be used to produce a uniform moisture content. The above description has expressed the cutting, cleaning and moisture control as separate steps. All three steps may be carried out simultaneously in a pulper according to known means.

The straw, now clean, uniformly moist and cut, is typically sprayed with a metered amount of cooking liquor in a mixer-impregnator 14. In the mixer-impregnator the cooking chemicals are thoroughly intermixed with the straw. Ordinarily the cooking liquor contains sodium hydroxide and sodium sulfide. Where the former is used the process is termed a soda process and where the latter is used the cooking is termed a sulfate process. The use of one or another of these is generally determined by the availability of the chemicals. Cooking liquor recipes are well known. The sulfate process is probably preferred unless the pulp is to be bleached. However in high strength applications, high brightness is not usually a requirement.

The chemicals become thoroughly mixed and the straw is forced into a compactor 15 and then by a screw feed into pressurized digesting tubes 16 and 17. In the digesting tubes, the mixture of straw and chemicals is cooked in a live steam environment. There are ordinarily a series of such tubes though only two are pictured for purposes of illustration. In the horizontal tubes of the digester, the consistency of the mixture is approximately 10 to 12 percent straw.

At the outlet of the last digester tube, the straw-liquor mixture is forced abruptly into a tank 20 which results in a "fiberizing" of the straw. This abrupt passage of the straw into the tank is called blowing and serves to break up the straw pieces into fibers. Preferably the fiber length is in the range of approximately 0.70 to 4.00 millimeters in length. Thus the blowing carried forward the work begun in the digester. The straw is now ready for refining and mixing except for the presence of the digesting chemicals which must be thoroughly removed. Removal of the chemicals may be carried out in a washer by adding a substantial amount of clean water to the mixture of straw and chemicals to produce a consistency of about 3.5 percent. At this consistency the chemicals are washed from the straw pulp, typically by multi-stage vacuum filter and centrifugal cleaners. Once the cleaning has been accomplished, the water is squeezed out to return the pulp to about 12 percent consistency.

The pulp is then refined aand mixed with pulp such as softwood pulp in a mixer 21. Additives such as rosin sizing may also be included where the end product application for the paper requires. After mixing, the various constituents are thoroughly interspersed in a furnish principally composed of cellulosic fibers which have been liberated to form a natural cellulose pulp. The consistency of the furnish is in the range of approximately 0.2 to 1.4 percent and it is at this consistency that the furnish is passed to the headbox 23 and thence onto the moving papermaking wire 24.

The drawing illustrates the suction box 25, the table rolls 26, couch roll 27, take-up roll 28 and four idler rolls all designated as 29. These elements along with the headbox and the Fourdrinier wire form the wet end or web-forming portion of the apparatus.

The furnish on the wire forms a wet mat as the water is removed. The mat is subjected to suction through means 25 which draws off the water from the mat it moves along on the wire. Surface tension of the water being drawn from the mat, the natural bonding of the fibers and bonding caused by additives all combine at this point in the manufacture to begin the true formation of the paper web by consolidation of the fiberous structure.

A further consolidation of the web is carried out in the press section designated generally as 30 of the papermaking machine. The press section is made of a plurality of drying drums 31 over which the web W is passed. Associated with the drying drums is an upper felt 32 and a lower felt 33 along with various tensioning and guiding rolls for each felt or fabric. The felts serve to hold the web against the drums. The drums are ordinarily heated to assist in the drying of the wet. Due to the rather excessive fines and fiber debris in straw webs, the felts should be an open type with a high porosity. Also same means should be provided for continuous cleaning in order to keep the felts from clogging and thus inhibiting drainage of water from the web. There may also be used press rolls which serve to squeeze the water from the web and assist in consolidation of the web in the press section of the papermaking machine.

The water to fiber ratiO of the web as it leaves the wire is approximately 4:1. This moisture must be reduced before the next major step in the web consolidation takes place. This next step is upsetting of the web fibers and should take place with the web moisture content in the range of approximately 30 to 50 percent wet by weight. An optimum wetness is considered to be about 37 percent.

The consolidating by upsetting of the fibers is carried out under forces which are applied generally parallel to the web faces while forces are simultaneously applied normal to the web surface. The result is that the individual fibers are crowded together and crimped and flexed upon themselves in a direction parallel to the web faces and entirely between the faces of the web.

This step can be best understood by reference to an apparatus which can be used to effect the individual web fiber upset. In general the preferred apparatus includes a soft surfaced roller or blanket which is urged against a hard, slippery surface. The soft surface is caused to recoil while against the hard surface. When the straw fiber web is placed in the nip formed by the two surfaces, this recoil causes the various web fibers to be moved generally randomly in the space between the web faces. More particularly the apparatus includes a thick elastomeric belt 40 which is carried by three idler rollers 41, 42 and 43. The idler rollers hold the belt or blanket against a large drum 44 about a part of the periphery of the drum. Bar 45 serves to press the blanket against the drum surface to form a localized pressure nip axially across the drum surface. The amount the blanket is wrapped around the drum is adjustable as is the nip bar pressure. The various adjusting means are not shown but are known in the art. As the belt 40 undergoes a reversal of its curvature in passing across the nip bar 45, the surface of the thick belt toward the drum is shortened and so moves slower than the drum surface. This difference in surface speeds causes a compression of the web fibers while at the same time the nip bar exerts sufficient pressure to prevent buckling of the web as a whole.

The belt or blanket is not driven independently by its own support rollers but rather by the engagement with the drum which is driven by means not shown in the drawing. The arc of contact of the belt must therefore be sufficient to provide the blanket drive. Since the amount of fiber upset is dependent upon the blanket contact or wrap as one of important parameters, the arc must be sufficient to provide the desired results.

An alternative means may include mating rollers, one elastomeric surfaced and one hard surfaced. The hard surfaced roll is driven while the elastomeric surfaced roll is braked. This arrangement creates the required elastomer recoil across the hard surface and the pressure which urges the two rolls into mating engagement serves to prevent web buckling. In either this or the previously described apparatus, it is preferable that the web be passed from the press section into the pressure nip under a tight draw.

It should be remembered that the straw fiber pulp and the other type or types of pulp must be well intermixed in order that the fibers of softwood etc. can assist in the inter-fiber bonding which is being enhanced by the upsetting or mechanical compacting of the web.

When it is desired to produce heavy weight (ream measure of 90 pounds per 3000 square feet and above), the treatment of the instant invention allows for the making of a heavier paper than could be produced on a similar capacity papermaking machine. This is true because consolidation of the web in the upsetting nip increases by approximately 10 percent the weight of the paper at the dry end of the machine. This allows a lower solids weight of the wet furnish to be run on the wire for the same weight of paper at the dry end of the machine. For example, to produce a 110 pound per 3000 square feet paper it is necessary only to run 100 pounds per 3000 square feet on the wire. The net effect is that the instant invention serves to increase the capacity of the papermaking machine by counteracting the slow draining characteristics of straw fibers.

From the compacting nip the paper is finally passed to a drying stack where the drying and smoothing of the web is carried out. It may be desirable in some instances to utilize a smooth surfaced drying roller or calender roller if a hard or glossy surface is desired.

As an illustrative example, sheets were produced according to the instant invention and then compared. Unbleached straw pulp was used along with long-fiber unbleached sulphate woodpulp. The straw pulp had a freeness of 74 seconds (Williams) and the woodpulp had a freeness of 29 seconds (Williams). The wire speed was 25 feet per minute and the wet end utilized a 10 inches of mercury vacuum. The headbox consistency was 0.64 percent and the basis weight at the wire was approximately 55 pounds per 3000 square feet. The sheets were introduced to the mechanical compactor at a 37 percent wetness and upset such that the sheet length was reduced about 12 percent.

Sheets were run with varying proportions of straw pulp to woodpulp and such things as T.E.A. (tensile energy absorption), elongation, edge tear and tensile strength were measured. These treated papers were compared with a standard untreated high grade multiwall sack paper of 100 percent sulphate pine. The test results showed that a treated web with as much as 80 percent straw exhibited higher edge tear, higher T.E.A. and percent elongation. However the ultimate tensile of the straw paper was somewhat reduced. A paper made of 100 percent straw exhibited a higher T.E.A. after treatment than did the standard multiwall sheet and compared favorably in tear and percent elongation. These test comparisons are set out in table I. All figures have been adjusted to a 100 grams per square meter basis weight for the purpose of the comparison.

TABLE 1

| % straw | Tensile (kg/15mm) | % Elongation | T.E.A. (cm kg/100cm$^2$) | Edge Tear (grms) |
|---|---|---|---|---|
| 30 | 2.25 | 9.6 | 10.4 | 6855 |
| 40 | 4.20 | 14.5 | 26.3 | 4086 |
| 50 | 3.64 | 11.9 | 20.5 | 3405 |
| 60 | 3.42 | 10.1 | 16.5 | 3587 |
| 70 | 2.95 | 7.9 | 11.7 | 3223 |
| 80 | 3.18 | 8.8 | 13.8 | 3677 |
| 90 | 4.80 | 11.3 | 24.8 | 2225 |
| 100 | 4.04 | 9.8 | 19.6 | 1725 |
| Control | 5.23 | 2.4 | 6.5 | 3360 |

The present invention has been described with reference to specific apparatus and specific method steps; however, it will be appreciated that a wide variety of changes may be made in both. For example, features of the invention may be utilized independently of others and equivalents may be substituted for the various method steps, all within the scope of the invention as defined in the claims.

I claim:

1. A paper constituently comprising in combination straw fiber of relatively short fiber length in the range of approximately 0.70 to 4.00 millimeters and relatively longer softwood fibers randomly and generally intermittently mixed with the straw fibers, the paper comprising at least 60% straw fiber with the balance of fibers comprising said relatively longer fibers, said paper having a basis weight of more than 55 pounds and having substantially all of its fiber laterally crimped and intertwined such that the paper exhibits substantial permanent extensibility in excess of the paper web as laid.

2. A high straw content paper suitable for use as high strength packaging paper and for making high strength multi-walled paper sacks, said paper comprising approximately 50 to 80% by weight straw fiber and the remainder softwood pulp fiber, a majority of straw fibers being in the range of approximately 0.70 to 4.00 millimeters in length, said individual straw fibers being randomly and generally uniformly intermixed with said softwood pulp fiber, crowded together and crimped and flexed upon themselves in a direction parallel to the web faces and entirely between the faces of the web, such that the paper exhibits, adjusted to a 100 grams per square meter basis weight, a percent elongation of about 7.9 to 11.0, tensile energy absorption of about 11.7 to 20.5 cm kg/100cm$^2$, and edge tear of about 3223 to 3677 gms.

3. A straw paper suitable for use as high strength packaging paper and for making high strength multiwalled paper sacks, said paper comprising approximately 50 to 80% by weight straw fiber and the remainder softwood pulp fiber, a majority of the straw fibers being in the range of approximately 0.70 to 4.00 millimeters in length, the straw fiber being randomly and generally uniformly mixed with said softwood pulp fiber, said straw paper having a basis weight of more than 55 pounds and having substantially all of its fibers locally crimped and intertwined such that the paper exhibits substantial permanent extensibility in excess of the paper web as laid and said straw paper having about equal or higher tensile energy absorption and edge tear strength than an equivalent weight of packaging paper made of 100% sulfate pine pulp.

4. A process for making straw paper comprising introducing cut straw into a digester, metering cooking liquor into mixture with the straw, cooking the straw liquor mixture under pressure and in the presence of superheated steam, blowing the straw, removing the spent liquor, mixing the straw with a softwood pulp, blending to form furnish containing approximately 50 to 80% straw and the remainder softwood pulp fiber, passing the furnish to a papermaking wire and moving the furnish of the papermaking wire under the influence of suction to remove water said paper at the wire having a basis weight of at least 55 pounds, drying the web to a range of approximately 30 to 50% moisture by weight, compressively compacting the web by passing the partially dry web to a pressure nip, compacting the fibers of the wire within the plane of the wire surface to increase the density of the web to a basis weight higher than the basis weight before compacting the fibers, wherein the compressive compacting of the fibers is carried out under forces which are applied generally parallel to the web faces while forces are simultaneously applied normal to the web surface and the individual fibers are crowded together and crimped and flexed upon themselves in a direction parallel to the web faces and entirely between the faces of the web, and then passing the web to drying rolls to complete the drying whereby said paper exhibits substantial permanent extensiblity in excess of the paper web as laid.

5. A process for making straw paper comprising introducing cut straw into a digester, metering cooking liquor into mixture with the straw, cooking the straw liquor mixture under pressure and in the presence of superheated steam, blowing the straw, removing the spent liquor, mixing the straw with a softwood pulp, blending to form a furnish containing approximately 50 to 80% straw and the remainder softwood pulp fiber, passing the furnish to a papermaking wire and moving the furnish on the papermaking wire under the influence of suction to remove water, drying the web to a range of approximately 30 to 50% moisture by weight, compressively compacting the web by passing the partially dry web to a pressure nip, compacting the fibers of the wire within the plane of the wire surface to increase the density of the web to a basis weight approximately 10% higher than the basis weight before compacting the fibers, wherein the compressive compacting of the fibers is carried out under forces which are applied generally parallel to the web faces while forces are simultaneously applied normal to the web surface and the individual fibers are crowded together and crimped and flexed upon themselves in a direction parallel to the web faces and entirely between the faces of the web, and then passing the web to drying rolls to complete the drying whereby said paper exhibits substantial permanent extensibility in excess of the paper web as laid and said straw paper adjusted to 100 gms per square meter basis weight having a percent elongation of about 7.9 to 11.9 tensile energy absorption of about 11.7 to 20.5 cm kg/100cm$^2$, and edge tear of about 3223 to 3677 gms.

6. A straw paper suitable for use as high strength packaging paper and for making high strength multiwalled paper sacks, said paper comprising at least 40% by weight straw fiber and the remainder softwood pulp fiber, a majority of the straw fibers being in the range of approximately 0.70 to 4.00 millimeters in length, said straw fiber being randomly and generally uniformly mixed with said softwood pulp fiber, said paper having a basis weight of more than 55 pounds, substantially all of its fibers locally crimped and intertwined such that the paper has a percent elongation of at least 7.9 and substantial permanent extensibility in excess of the paper web as laid.

7. A process for making straw paper comprising introducing cut straw into a digester, metering cooking liquor into mixture with the straw, cooking the straw liquor mixture under pressure and in the presence of superheated steam, blowing the straw, removing the spent liquor, mixing the straw with a softwood pulp, blending to form a furnish containing at least 40% straw and the remainder softwood pulp fiber, passing the furnish to a papermaking wire and moving the furnish on the papermaking wire under the influence of suction to remove water, said paper at the wire having a basis weight of at least 55 pounds, drying the web to a range of approximately 30 to 50% moisture by weight, compressively compacting te web by passing the partially dry web to a pressure nip, compacting the fibers of the wire within the plane of the wire surface to increase the density of the web to a basis weight higher than the basis weight before compacting the fibers, wherein the compressive compacting of the fibers is carried out under forces which are applied generally parallel to the web faces while forces are simultaneously applied normal to the web surface and the individual fibers are crowded together and crimped and flexed upon themselves in a direction parallel to the web faces and entirely between the faces of the web, and then passing the web to drying rolls to complete the drying, said paper having a percent elongation of at least 7.9 and having substantial permanent extensibility in excess of the paper web as laid.

* * * * *